US006995665B2

(12) United States Patent
Appelt et al.

(10) Patent No.: US 6,995,665 B2
(45) Date of Patent: Feb. 7, 2006

(54) SYSTEM AND METHOD FOR IDENTIFYING, MONITORING AND EVALUATING EQUIPMENT, ENVIRONMENTAL AND PHYSIOLOGICAL CONDITIONS

(75) Inventors: Daren R. Appelt, Austin, TX (US); Kevin K. Brunson, Aledo, TX (US); James D. Hibbs, Smithville, TX (US)

(73) Assignee: FireEye Development Incorporated, Austin, TX (US)

( * ) Notice: Subject to any disclaimer, the term of this patent is extended or adjusted under 35 U.S.C. 154(b) by 88 days.

(21) Appl. No.: 10/610,013

(22) Filed: Jun. 30, 2003

(65) Prior Publication Data

US 2004/0004547 A1 Jan. 8, 2004

Related U.S. Application Data

(63) Continuation-in-part of application No. 10/147,584, filed on May 17, 2002, now Pat. No. 6,700,497.

(60) Provisional application No. 60/393,221, filed on Jul. 2, 2002.

(51) Int. Cl.
*G08B 19/00* (2006.01)

(52) U.S. Cl. ..... 340/521; 340/523; 128/204.23; 128/204.24

(58) Field of Classification Search ..... 340/521, 340/523, 584, 586, 573.1, 573.4; 128/204.22, 128/204.23, 202.19, 206.24, 206.26, 903, 128/201.27; 600/585
See application file for complete search history.

(56) References Cited

U.S. PATENT DOCUMENTS 3,201,771 A 8/1965 Proulx ..... 340/586
4,709,202 A 11/1987 Koenck et al. ..... 320/112
4,727,359 A 2/1988 Yuchi et al. ..... 340/518
4,733,383 A * 3/1988 Waterbury ..... 368/10
4,996,981 A 3/1991 Elenewski et al. ..... 128/201.15
5,157,378 A 10/1992 Stumberg et al. ..... 340/521
5,200,736 A 4/1993 Coombs et al. ..... 340/586
5,283,549 A 2/1994 Mehaffey et al. ..... 340/521
5,301,668 A 4/1994 Hales ..... 128/205.23
5,398,023 A 3/1995 Murray ..... 340/7.63
5,428,964 A 7/1995 Lobdell ..... 62/176.6
5,457,284 A * 10/1995 Ferguson ..... 128/201.27
5,483,229 A 1/1996 Tamura et al. ..... 340/691.7
5,541,579 A 7/1996 Kiernan ..... 340/573.1
5,552,772 A 9/1996 Janky et al. ..... 340/573.4
5,558,084 A 9/1996 Daniell et al. ..... 128/203.17
5,635,909 A 6/1997 Cole ..... 340/586
5,640,148 A 6/1997 Lewis et al. ..... 340/573.1
5,659,296 A 8/1997 Debe et al. ..... 340/632
5,689,234 A 11/1997 Stumberg et al. ..... 340/521
5,691,707 A 11/1997 Smith ..... 340/682
5,781,118 A 7/1998 Wise et al. ..... 340/632
5,917,416 A 6/1999 Read ..... 340/584
5,973,602 A 10/1999 Cole, III et al. ..... 340/584
6,075,445 A 6/2000 McLoughlin et al. ..... 340/586
6,084,522 A 7/2000 Addy ..... 340/630
6,091,331 A 7/2000 Toft et al. ..... 340/539.11
6,118,382 A 9/2000 Hibbs et al. ..... 340/586

(Continued)

*Primary Examiner*—Van T. Trieu
(74) *Attorney, Agent, or Firm*—Baker Botts L.L.P.

(57) ABSTRACT

A system and method are disclosed for identifying monitoring and evaluating hazardous or potentially hazardous conditions. The system may be worn by safety personnel to detect equipment conditions such as low power supply, environmental conditions such as ambient temperature and/or physiological conditions such as heart rate of a wearer. The system further includes a control unit having electronics operable to communicate signals associated with equipment, environmental and physiological conditions.

17 Claims, 7 Drawing Sheets

U.S. PATENT DOCUMENTS 6,199,550 B1 * 3/2001 Wiesmann et al. .... 128/204.23
6,201,475 B1 * 3/2001 Stumberg et al. ..... 340/573.1
6,255,650 B1 * 7/2001 Warner et al. ..... 250/330
6,360,182 B1 * 3/2002 Hales ..... 702/139
6,417,774 B1 7/2002 Hibbs et al. ..... 340/584
6,491,647 B1 * 12/2002 Bridger et al. ..... 600/585

* cited by examiner

FIG. 4
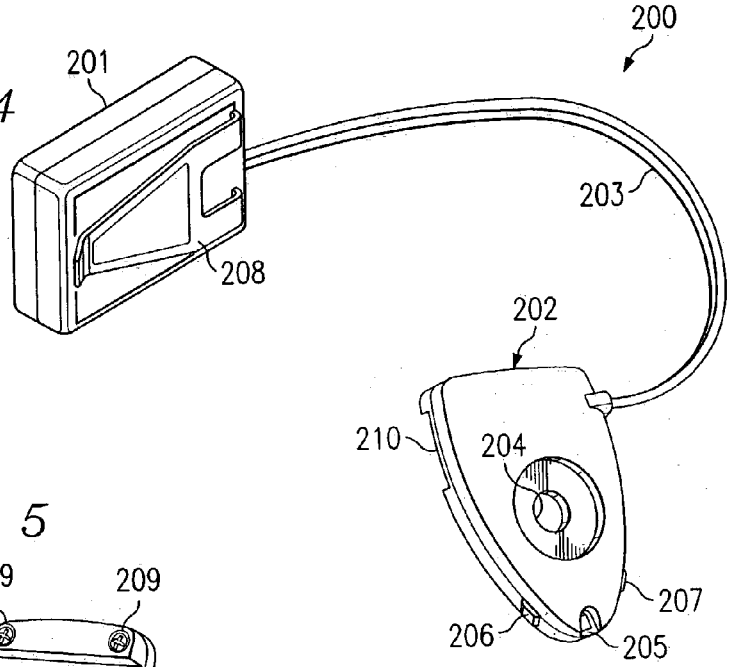
FIG. 5
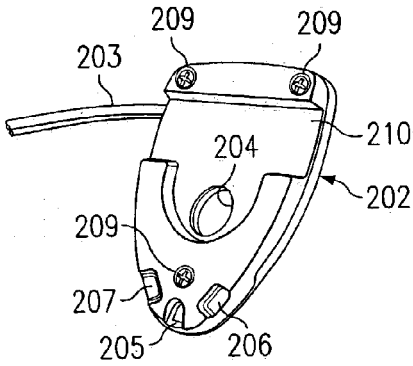
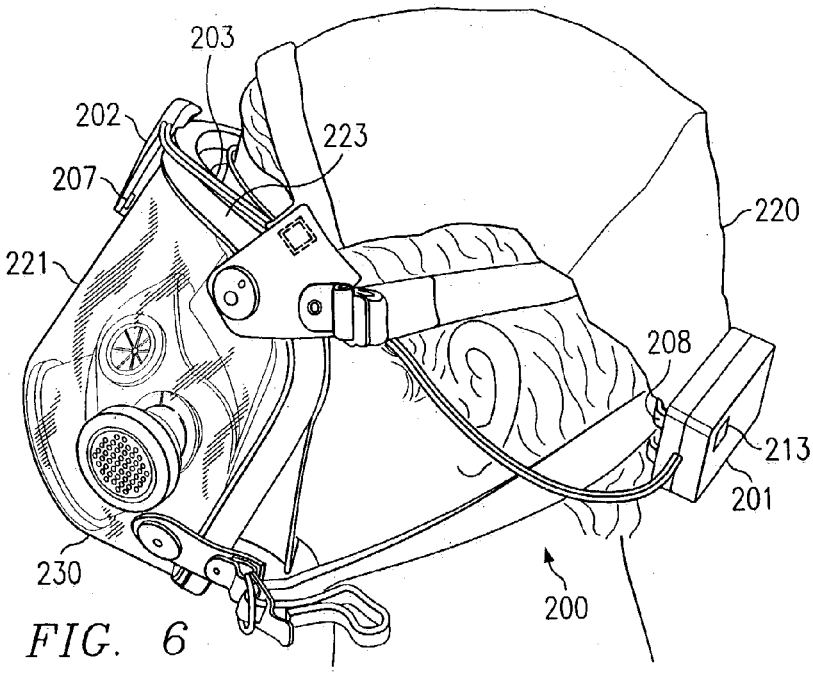
FIG. 6

FIG. 7
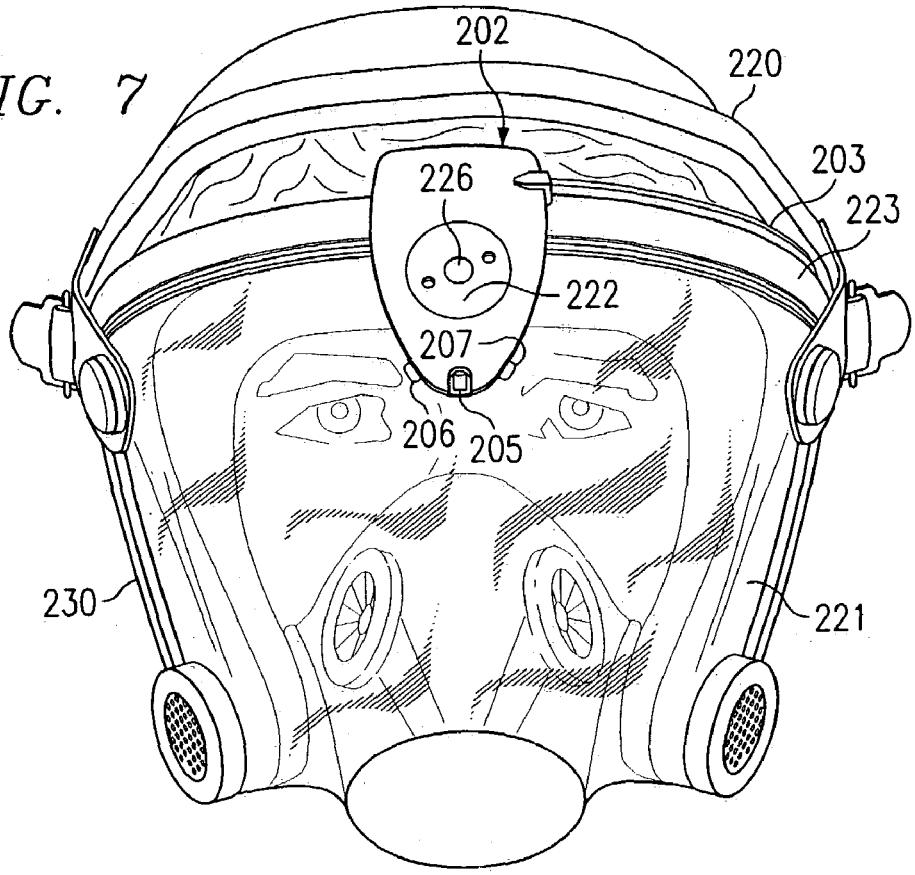
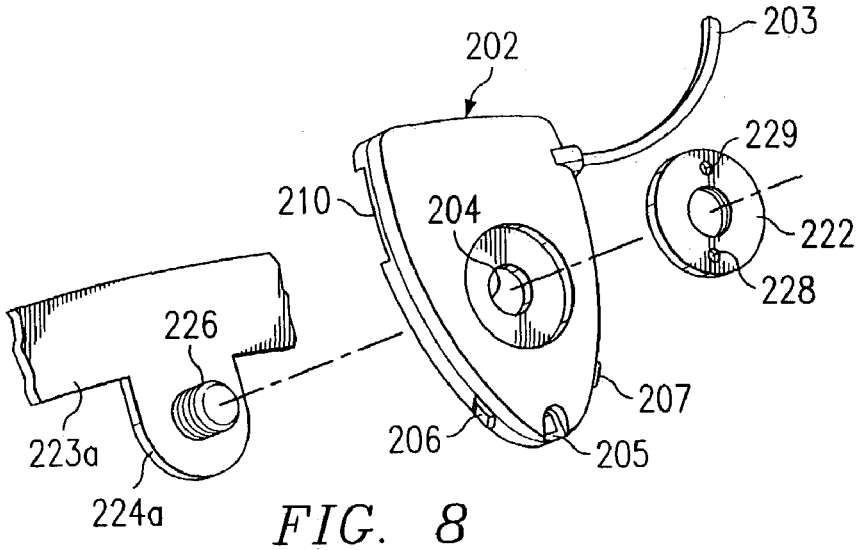
FIG. 8

SYSTEM AND METHOD FOR IDENTIFYING, MONITORING AND EVALUATING EQUIPMENT, ENVIRONMENTAL AND PHYSIOLOGICAL CONDITIONS

CROSS-REFERENCE TO RELATED APPLICATIONS

This application claims the benefit of provisional U.S. Application Ser. No. 60/393,221 filed Jul. 2, 2002 entitled System and Method for Identifying, Monitoring and Evaluating Environmental and Physiological Conditions.

This application claims priority to and is a continuation-in-part of U.S. Continuation application Ser. No. 10/147,584, filed May 17, 2002, entitled System and Method for Identifying Unsafe Temperature Conditions, now U.S. Pat. No. 6,700,497.

TECHNICAL FIELD OF THE INVENTION

The present invention relates in general to safety equipment for personnel exposed to hazardous or potentially hazardous conditions and, more particularly, to a system and method for identifying, monitoring and evaluating selected equipment, environmental and physiological conditions.

BACKGROUND OF THE INVENTION

Personnel exposed to hazardous or potentially hazardous conditions typically use a wide variety of protective equipment as appropriate for each respective condition. For example, firefighters, when fighting a fire, generally wear a coat, boots, gloves and other clothing specially created to protect against fire and heat as well as self contained breathing equipment. Although such clothing and equipment provides some protection, firefighter's still face significant dangers including potential flashover. Once ambient temperature in a fire reaches about six hundred degrees Fahrenheit (600 degrees Fahrenheit), the temperature may quickly rise to over eleven hundred degrees Fahrenheit (1100 degrees Fahrenheit). At this point, flashover may occur in which the air ignites and kills or severely injures firefighters. Thus, it is unsafe for personnel to fight fires from within a structure once ambient temperature reaches approximately six hundred degrees Fahrenheit (600 degrees Fahrenheit).

For other hazardous or potentially hazardous conditions, such as working with explosive, radioactive and/or biologically harmful materials, there are various thresholds and levels beyond which it is unsafe to continue working. Personnel working in hazardous or potentially hazardous conditions must be aware of their respective physiological conditions. An increase in heart rate or problems with breathing may be as hazardous for a firefighter as working in a location with an ambient temperature above six hundred degrees Fahrenheit (600 degrees Fahrenheit).

To alleviate some of the dangers involved in fire fighting, various electronic devices have been developed to provide warnings to firefighters. For example, U.S. Pat. No. 5,640,148 discloses a dual activation alarm system for a personal alert safety system (PASS). U.S. Pat. No. 5,635,909 discloses a temperature monitoring assembly that is incorporated into a garment such as a coat. U.S. Pat. No. 5,541,549 discloses a personal alarm safety system that is designed as part of the firefighter's belt. U.S. Pat. No. 5,137,378 discloses an integrated firefighter safety monitoring and alarm system that provides a number of warnings to a firefighter.

This system includes temperature monitoring, an audible alarm and a display to provide additional information including a visible warning.

A wide variety of detectors, sensors and monitors are commercially available to warn personnel about potentially explosive mixtures, increased radiation levels above normal background and the presence of biological hazards. Such detectors, sensors and monitors may be installed at fixed locations, hand held or attached to clothing and other safety equipment associated with personnel working in hazardous or potentially hazardous conditions.

Even with such conventional devices, firefighters are still injured or killed by flashovers and workers are injured or killed by industrial explosions. The complexity of conventional devices, the difficulties of fire fighting environments and the type and location of the warnings often cause firefighters not to hear audible warnings or not to see visible warnings of dangerous ambient temperatures. It is often even more difficult for workers to recognize and take appropriate action when exposed to hazardous or potentially hazardous explosive, radioactive and/or biologically harmful conditions.

Prior temperature sensors and detectors associated with fire fighting equipment generally do not provide confirmation of satisfactory temperature measurements at a field location. Calibration at a testing facility or laboratory is often the only way to confirm satisfactory temperature measurements by most conventional temperature sensors and detectors.

SUMMARY OF THE INVENTION

In accordance with teachings of the present invention, a system and method are provided to identify, monitor and evaluate environmental and physiological conditions. One embodiment of the present invention includes a personal situation awareness device which may be used by a person exposed to hazardous or potentially hazardous conditions. Personal situation awareness devices incorporating teachings of the present invention may be used to identify and monitor variable relationships between environmental conditions exterior to a person's safety equipment, environmental conditions within an interior of the safety equipment and/or the safety equipment itself and associated physiological condition effects of combined environmental and physiological conditions on the respective person. Identifying, monitoring and evaluating exterior environmental conditions, interior environmental conditions and associated physiological effects may substantially reduce the number of injuries and/or deaths from working with hazardous or potentially hazardous conditions.

The present invention allows design, development and manufacture of personal situation awareness devices which may be used to prevent injury and/or death of personnel working in hazardous or potentially hazardous conditions. Personal situation awareness devices incorporating teachings of the present invention may be used to identify, monitor and evaluate physiological conditions of a wearer. Such personal situation awareness devices may also monitor variable relationships between environmental conditions and physiological conditions of the wearer. Such personal situation awareness devices may be used to collect data, interpret data and communicate with other individual wearers and/or with one or more remote locations. Such devices may analyze data and initiate appropriate alerts and warnings.

Another aspect of the present invention includes collecting and storing data related to environmental conditions, such as the temperature of a firefighter's safety equipment, the temperature at various locations in a fire, the presence of explosive gases, biological agents, radionuclides and/or other harmful or potentially harmful materials. Data concerning operation of safety equipment such as air supply temperature and/or pressure, air flow rates, battery power levels, and communication links may also be collected and stored. Data concerning physiological conditions of a person working in a hazardous or potentially hazardous environment including, respiration rate, blood oxygen levels, core body temperature and heart rate may also be monitored and evaluated. A personal situation awareness device incorporating teachings of the present invention may be used to analyze equipment, environmental and physiological data in an organized, prioritized and meaningful way and communicate critical data so that immediate action may be taken to prevent injury or loss of life from over exposure to one or more critical conditions.

A further aspect of the present invention includes onboard storage of data regarding standard Personal Exposure Limits and, optionally, personal physiological limits of the person using the invention. Such information makes it possible for the present invention to even more accurately warn of hazardous or potentially hazardous conditions.

Technical benefits of the present invention include a reliable source of data or information which may be communicated to a command station. The data or information may also be communicated to other personnel working in proximity with the wearer. The data or information may be recorded, interpreted and evaluated. Data from one or more personal situation awareness devices may be used to provide guidance in taking appropriate action with respect to each person working in a hazardous or potentially hazardous environment or with respect to all people working in a hazardous or potentially hazardous environment.

According to one aspect of the present invention, a system is provided to identify, monitor and alert personnel of a critical condition or conditions. The system may include a control unit stored within a housing. The control unit may include electronics operable to identify, monitor, record, evaluate and communicate a signal associated with at least one environmental or physiological condition. The system may also include a sensor unit communicatively coupled to the control unit. The sensor unit may be positioned within an environment at a distance from the control unit. The sensor unit may include multiple sensors operable to sense ambient air temperature, oxygen levels or lack of oxygen, concentration of harmful chemicals and gases, explosive materials, radioactive materials, equipment temperature and physiological characteristics of a wearer. The system may include one or more indicators operable to provide an indication representing at least one critical condition and one or more communicators to transmit and receive information.

Another aspect of the present invention may include connecting sensors, displays and power sources that may be part of an SCBA system or other safety equipment associated with a person wearing the safety system. By sharing sensors, displays and power sources with other elements, an entire ensemble worn by the person may be manufactured more efficiently and provide increased service life.

The system may include a control unit operable to be coupled to safety equipment or to a person working in a hazardous or potentially hazardous condition. The control unit may have electronics operable to communicate data associated with environmental and physiological conditions. For one application the system may include a sensor unit or a sensor assembly operable to be positioned in an ambient environment and coupled with a face mask. For other applications a sensor unit may be positioned at optimum locations or associated safety equipment. The sensor unit or sensor assembly may include one or more sensors having an operating mode dependent upon the presence of one or more hazardous or potentially hazardous conditions. The sensor unit or sensor assembly may be communicatively coupled to the control unit.

A further aspect of the present invention includes sensors, displays, and other elements of a safety system communicatively coupled with each other to efficiently share data and information. For example, radio signals, light beams, pressure pulses, sound waves, and/or electrical wiring may be used where appropriate to communicate information from one element of the system to another.

One aspect of the present invention includes a system which may be used to measure temperature gradients between ambient temperature and temperature of safety equipment worn by a person fighting a fire. For cold environments, a system may be provided to measure temperature gradients between ambient temperature and core body temperature. The system may use various factors such as the temperature gradient and the "heat sink effect" of the safety equipment to calculate satisfactory stay times for working in the environment and appropriate temperature limits. For other applications the system may be used to measure temperature and/or other environmental conditions at extended distances, intermediate distances and immediately adjacent to a person wearing the system.

Technical benefits of the present invention include a field calibration check feature to determine if one or more sensors are operating satisfactorily. For example, a mixture of water and ice may be used to confirm or check satisfactory calibration and operation of a temperature detector and associated electronic circuits.

Systems incorporating teachings of the present invention may be used to provide early warning of excessive temperatures that would eventually lead to a flashover or other danger. In general, once ambient temperature in a building or structure fire reaches 300 degrees Fahrenheit, the temperature will start rising. Frequently it takes around two (2) minutes for ambient temperatures in a building for to linearly, increase from 300 degrees to 600 degrees Fahrenheit. Once the temperature reaches approximately 600 degrees Fahrenheit, ambient temperature will often start rising exponentially to over 1100 degrees Fahrenheit in less than a minute. This fatal phenomenon is termed a flashover. It is appropriate to evacuate buildings or other structures once the temperature reaches around 600 degrees Fahrenheit. Further, other temperature related conditions may be unsafe for firefighters. For example, remaining in a high ambient temperature for a certain period of time may be dangerous.

The present invention provides systems and methods to identify, monitor and evaluate equipment, environmental and physiological conditions which extend beyond fire fighting applications. Similar critical conditions and corresponding set points may be included in systems exposed to radioactive materials, biologically hazardous materials, low oxygen levels and explosive gas mixtures. Personal situation awareness tools and devices incorporating teaching of the present invention may become mandatory for use by anyone who may be exposed to hazardous or potentially hazardous conditions.

BRIEF DESCRIPTION OF THE DRAWINGS

A more complete understanding of the present invention and advantages thereof may be acquired by referring to the following description taken in conjunction with accompanying drawings in which like reference numbers indicate like features and wherein:

FIG. 4 is a schematic drawing showing an isometric view of a system operable to identify, monitor, evaluate and alert safety personnel of hazardous or potentially hazardous conditions in accordance with teachings of the present invention;

FIG. 5 is a schematic drawing showing a rear perspective view of the sensor assembly in FIG. 4 incorporating teachings of the present invention;

FIG. 6 is a schematic drawing showing a perspective, side view of the system of FIG. 4 coupled to a face mask according to one embodiment of the present invention;

FIG. 7 is a schematic drawing in elevation showing a front view of the system and face mask of FIG. 4;

FIG. 8 is a schematic drawing showing an exploded, isometric view of a fastener system satisfactory for attaching a sensor unit incorporating teachings of the present invention with a face mask;

DETAILED DESCRIPTION OF THE INVENTION

Figure 1:
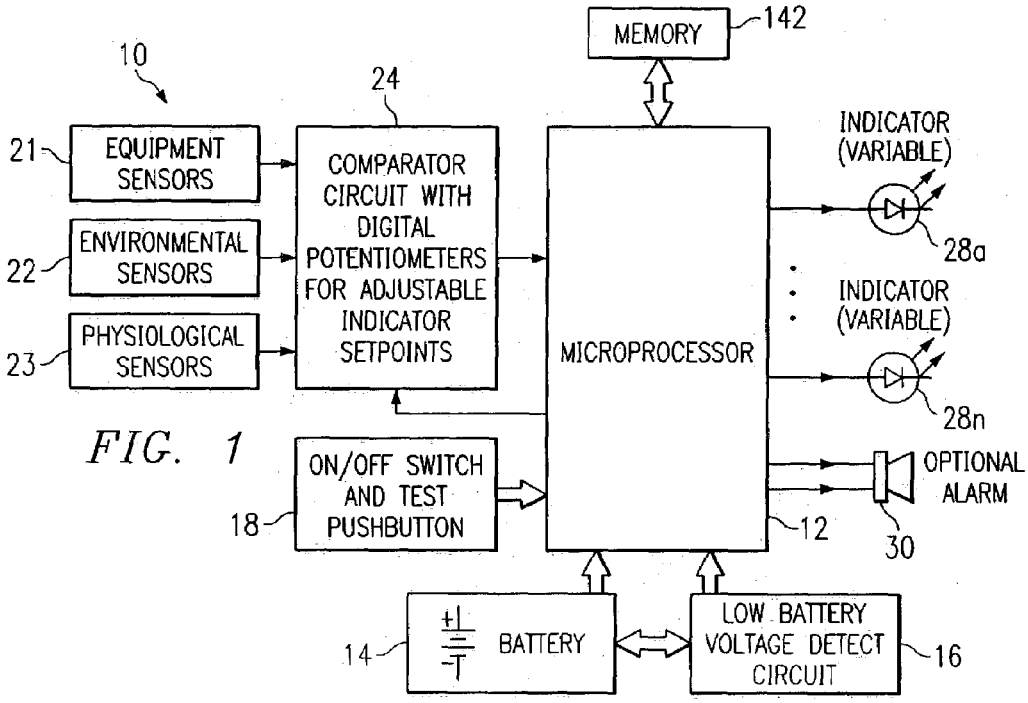
FIG. 1 is a block diagram of one embodiment of a system operable to identify, monitor, evaluate and alert personnel of hazardous or potentially hazardous conditions in accordance with teachings of the present invention.

Preferred embodiments of the present invention and its advantages are best understood by referring to FIGS. 1–14 of the drawings, in which like numbers reference like parts.

The terms "safety equipment" and "protective equipment" are used throughout this application to include any type of clothing such as a coat, vest, hat, apron, boots and/or gloves which may be used to protect a wearer from hazardous or potentially hazardous environments. The terms "protective equipment" and "safety equipment" may also include helmets, visors, hoods, face masks, oxygen tanks, air bottles, self-contained breathing apparatus (SCBA), chemical suits and any other type of clothing or device which may be worn by a person to protect against fire, extreme temperatures, reduced oxygen levels, explosions, reduced atmospheric pressure, radioactive and/or biologically harmful materials.

The term "environmental conditions" is used throughout the application to include both external environmental conditions (ambient air temperature, wind conditions, barometric pressure, gas concentrations, oxygen levels, etc.) and internal environmental conditions (temperature of safety equipment, air temperature and pressure within a biological or chemical clean up suit, gas concentrations within a biological or chemical clean up suit, etc.). Environmental conditions may include the operating condition of safety equipment and the results of using such safety equipment such as air capacity and flow rates to a person wearing an SCBA.

The term "hazardous or potentially hazardous conditions" is used throughout this application to include environmental conditions such as high ambient temperature, lack of oxygen, and/or the presence of explosive, exposure to radioactive or biologically harmful materials and exposure to other hazardous substances. Examples of hazardous or potentially hazardous conditions include, but are not limited to, fire fighting, biological and chemical contamination clean-ups, explosive material handling, working with radioactive materials and working in confined spaces with limited or no ventilation. The term "hazardous or potentially hazardous conditions" may also be used throughout this application to refer to physiological conditions associated with a person's heart rate, respiration rate, core body temperature or any other condition which may result in injury and/or death of an individual. Depending upon the type of safety equipment, environmental conditions and physiological conditions, corresponding thresholds or levels may be established to help define potential hazardous conditions, hazardous conditions and critical conditions.

Permissible exposure limits (PELs) have been established by the U.S. Department of Labor Occupational Safety & Health Administration (OSHA) to protect workers against the effects of exposure to various hazardous or potentially hazardous materials and substances. PELs are frequently associated with air quality standards. Threshold limit values (TLVs) have been established by the American Conference of Governmental Industrial Hygienists to help establish safe working environments when exposed to various hazardous or potentially hazardous materials and substances. Both PELs and TLVs may be used to define one or more critical conditions and an acceptable length of time, if applicable, for exposure to each critical condition. Workplace environmental exposure limits (WEELs), recommended exposure limits (RELs) and industry developed occupational exposure limits (OELS) may also be used to establish one or more critical conditions and acceptable length of time, if applicable, for exposure to each critical condition.

A data base with appropriate PELs, TLVs, WEELs, RELs and OELs may be stored within memory 142 or data storage 542*a*. See FIGS. 1, 2, and 14. Also, an appropriate data base with this same information may be stored at a remote facility such as remote data storage 542*b* and communicated with safety system 500 through an appropriate communication link. See FIG. 14.

The term "critical condition" is used throughout this application to define a hazardous or potentially hazardous condition which may result in injury or loss of life. A critical conditional may be a hazardous or potentially hazardous environmental condition. A critical condition may also be a hazardous or potentially hazardous physiological condition or a combination of environmental and physiological conditions including the rate of change of such conditions. Depending upon the type of safety equipment, environmental conditions and physiological conditions, corresponding thresholds or levels may be established to help define potential hazardous conditions, hazardous conditions and critical conditions.

The term "critical data" is used throughout this application to include any information or data which indicates the presence of a hazardous or potentially hazardous condition or the presence of a critical condition. The rate of change of environmental conditions and/or physiological conditions may be "critical data".

FIG. 1 is a block diagram of one embodiment of a system, indicated generally at 10, operable to identify, monitor, evaluate and alert personnel of hazardous or potentially hazardous conditions according to teachings of the present invention. System 10 may include microprocessor 12 which receives power from battery 14. Microprocessor 12 may serve as a control unit for system 10. However, a wide variety of other control units such as digital signal processors and general purpose microprocessors or microcontrollers may also be satisfactorily used.

Battery 14 may be replaced by a user and may be conserved by switching system 10 off when not in use. System 10 may also include a low battery voltage detection circuit 16 and may be turned on and off by combined on/off switch and test button 18. Switch 18 may be backed up by an automatic switch (not expressly shown) that turns system 10 on when a hazardous or potentially hazardous condition reaches a selected set point, such as ambient temperature greater than one hundred fifty degrees Fahrenheit (150° F.) or heart rate greater than one hundred twenty (120) beats per minute.

Equipment sensors 21 may be used to monitor and measure data related to equipment temperature, air supply temperature and/or pressure, air flow rates, battery power levels, status of communication links and/or any other data required to monitor and evaluate satisfactory performance of any equipment associated with a person wearing system 10. Environmental sensors 22 may be used to detect, identify and measure a variety of environmental conditions such as ambient air temperature, explosive gas concentrations, biological agent concentrations, radioactivity levels associated with one or more radionuclides and/or any other hazardous or potentially hazardous environmental condition. For some applications equipment sensors 21 may be included as part of environmental sensors 22. Physiological sensors 23 may be used to monitor various physiological conditions such as respiration rate, blood oxygen level, core body temperature, heart rate and/or any other physiological condition required to identify, monitor and evaluate the physiological condition of a person wearing system 10. Equipment sensor 21 and/or physiological sensor 23 may also be used to measure movement or lack of movement by a wearer and/or equipment associated with the wearer. For some applications, a global positioning system or other location sensor (not expressly shown) may be coupled with microprocessor 12 and/or comparator circuit 24.

For some applications equipment sensors 21, environmental sensors 22 and physiological sensors 23 may include digital potentiometers (not expressly shown) which may be used to provide adjustable set points to indicate the presence of one or more hazardous or potentially hazardous conditions and one or more critical conditions. Environmental sensors 22 may include a resistive temperature device (RTD), thermocouple, thermistor, infrared (IR) sensor, pressure detector, gas detector, radiation detector, biohazard detector, video camera or any other environmental detector. System 10 may have multiple thresholds or set points corresponding with different levels for potentially hazardous conditions, hazardous conditions and critical conditions. Additional thresholds or set points may be implemented by system 10 when appropriate. Also, one or more set points may be set or modified by signals from microprocessor 12.

In operation, comparator circuit 24 provides a signal to microprocessor 12 in response to a comparison between respective set points and respective outputs from equipment sensors 21, environmental sensors 22 and physiological sensors 23. Microprocessor 12 may then provide signals to drive or actuate one or more visible indicators 28*a* through 28*n*. Various types of light emitting diodes (LED), liquid crystal displays (LCD), portions of a heads-up-display, fiber optic indicators or incandescent indicators may be used as visible indicators 28*a* through 28*n*. For one embodiment, visible indicators 28*a* through 28*n* may indicate ambient temperatures of 300 degrees Fahrenheit and 600 degrees Fahrenheit and heart rates of 120 beats per minute and 150 beats per minute. However, these set points are preferably variable and may have other values. Microprocessor 12 may provide signals to an optional alarm 30. Alarm 30 may, for example, be an audible or vibration alarm. Visual indicators 28*a*–28*n* may be green and red indicators such as light emitting diodes (LEDs) or miniature incandescent lights. Visual indicators 28*a*–28*n* may be mounted within the peripheral vision of a person wearing a face mask, helmet, self-contained breathing apparatus (SCBA) or other protective equipment. Visual indicators 28*a*–28*n* may be set to glow when an environmental and/or physiological condition reaches a respective set point. Early signaling will afford personnel wearing system 10 with ample time to react to the corresponding critical condition and make informed decisions as to whether to proceed or withdraw. Not only will the present invention save many lives, but, in turn, will also save money that would otherwise be spent on treatment of injured personnel and/or replacing damaged safety equipment and associated downtime costs.

Microprocessor 12 may provide additional enhancements to identify, monitor, evaluate and alert a wearer of hazardous or potentially hazardous conditions. For example, system 10 may use time averaged measurements for additional or alternate indicators. Such time averaged measurements are helpful to identify when a wearer has been exposed to a hazardous or potentially hazardous condition for a given amount of time. With respect to fire fighting such time averaged measurements may include: 160 degrees Fahrenheit for sixty seconds, 180 degrees Fahrenheit for thirty seconds, 212 degrees Fahrenheit for fifteen seconds, and 500 degrees Fahrenheit for ten seconds. System 10 may react to such events by providing additional visible indicators and/or alarms. Sensors 21, 22, and 23 along with comparator 24 and microprocessor 12 provide substantial flexibility in programming system 10 for a wide variety of hazardous or potentially hazardous conditions with appropriate set points selected for each critical condition.

System 10 may record an exposure history for post-event analysis and for training personnel. For example, ambient air temperature in a fire fighting environment may be recorded at specified time intervals to give firefighters or other safety personnel an idea of temperature profiles during training or while working within a structure fire or other hazardous site. System 10 may include global positions system (GPS) devices or other equipment to determine location and "map" temperature gradients or other potentially hazardous conditions within a site. Recorded data may be placed in an on-board random access memory (not expressly shown) or other digital data recorder. Recorded data, including position information, may be used to improve supervision of firefighters and other safety personnel and to provide better training for such personnel. System 10 allows better standardization of policies, practices and procedures with respect to personnel working in hazardous or potentially hazardous conditions.

Figure 2:
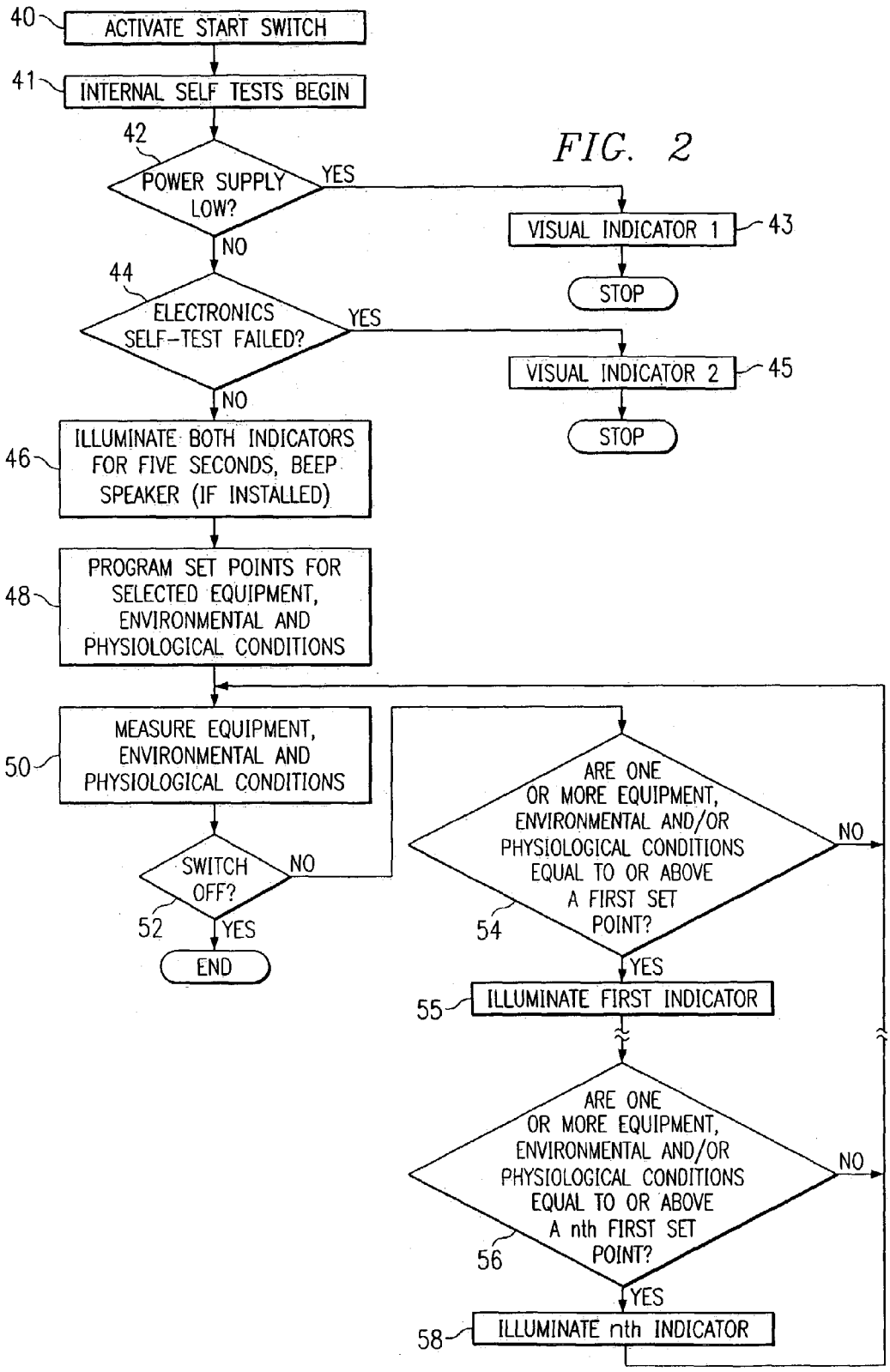
FIG. 2 is a flow chart of one embodiment of a method to identify, monitor, evaluate and alert personnel of hazardous or potentially hazardous conditions in accordance with teachings of the present invention.

FIG. 2 is a flow chart of one embodiment of a method for alerting safety personnel of hazardous or potentially hazardous conditions according to the present invention. As shown, at step 40, a start switch may be activated. This activation may be manual or automatic. At step 41, a system incorporating teachings of the present invention may begin an internal self test. At step 42, the system checks whether the battery or other power supply is low. If so, at step 43, the system flashes one or more visual indicators to signal the problem. At step 44, the system determines whether the self-test failed. If so, at step 45, the system flashes one or more visual indicators to signal this failure. If the test did not fail, at step 46, the system may illuminate one or more visual-indicators for five seconds and beep on a speaker (if any) or activate a vibrator (if any).

At step 48, the system may allow a wearer to program set points for respective equipment, environmental and physiological conditions. For some applications the set points may already be established. At step 50, the system measures selected equipment, environmental and physiological conditions using associated equipment sensors, environmental sensors and physiological sensors. At step 52, the system determines if it is switched off. If so, then the process stops. Otherwise, the system checks, at step 54, whether one of the equipment, environmental or physiological conditions is at a first set point (e.g., ambient air temperature 300 degrees Fahrenheit, 120 heart beats per minute, air supply temperature 100 degrees Fahrenheit) or greater. If not, then the system returns to measuring selected equipment, environmental and physiological conditions. If one of the equipment, environmental or physiological conditions is greater than the first set point, the system may illuminates one or more visual indicators in step 55. At step 56, the system may check whether the equipment, environmental or physiological condition is greater than a second set point (e.g., ambient air temperature 600 degrees Fahrenheit, 140 heart beats per minute or air supply temperature 110 degrees Fahrenheit). If not, the system returns to measuring selected equipment, environmental and/or physiological conditions of step 50.

If the equipment, environmental or physiological condition is greater than the second set point, the system may illuminate one or more visual indicators in step 58 and then return to measure selected equipment, environmental and physiological conditions. In this manner, the system continually monitors selected equipment, environmental and physiological conditions and provides visible warning of any equipment, environmental and physiological condition which is above the respect first or second set point.

Other embodiments of the present invention may include other steps. For example, another embodiment may include time averaged measurements for averaging equipment, environmental and physiological conditions over a specified interval of time and alerting a person wearing the system when a hazardous or potentially hazardous condition is present.

Visible indicators may be placed in the field of view, for example, while a firefighter is fighting a fire. When at least one equipment, environmental or physiological condition reaches a first set point (e.g., ambient temperature 300 degrees Fahrenheit, 130 heart beats per minute, air supply temperature 100 degrees Fahrenheit), a first indicator may be illuminated and stay on as long as the condition is at the first set point or above. When the condition reaches a second set point (e.g., ambient temperature 600 degrees Fahrenheit or 150 heart beats per minute, air supply temperature 120 degrees Fahrenheit), the second indicator may be illuminated and stay on as long as the condition is at the second set point or above. The second indicator may indicate that there is a very short time period before the equipment, environmental or physiological condition reaches a critical condition. The person wearing the system should consider immediately leaving the area to avoid a life threatening situation when the second indicator is illuminated.

The first set point may be preset at a manufacturer's suggested level for normal functioning of associated safety equipment to serve as an indicator of satisfactory equipment operation. The second set point may be selected to indicate a critical condition such as equipment failure or personal injury. As mentioned above, equipment, environmental and physiological set points may be varied by reprogramming comparator circuit 24 and/or microprocessor 12 to provide alerts for any critical condition.

Figure 3:
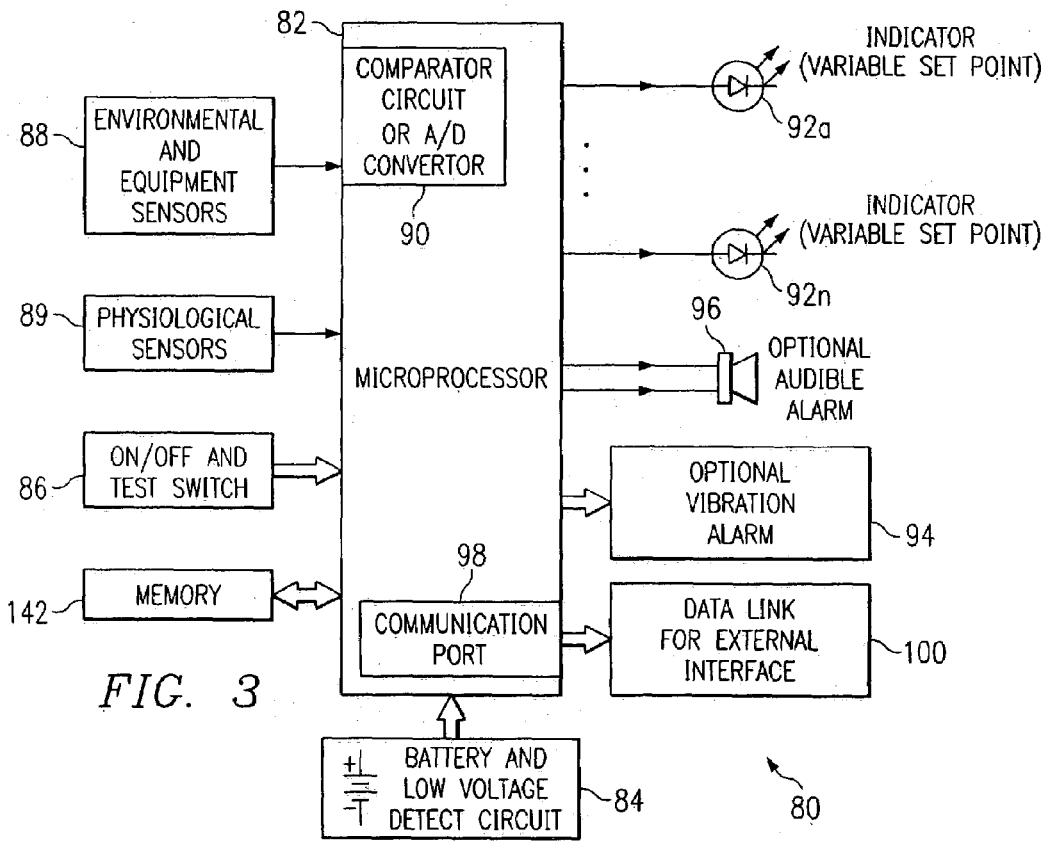
FIG. 3 is a block diagram of another embodiment of a system operable to identify, monitor, evaluate and alert personnel of hazardous or potentially hazardous conditions in accordance with teachings of the present invention.

FIG. 3 is a block diagram of system 80 operable to alert a person wearing this system of hazardous or potentially hazardous conditions in accordance with teachings of the present invention. For the embodiment of FIG. 3, system 80 includes microprocessor 82 that receives power from battery and low voltage detection circuit 84. Power supplies (not expressly shown) other than a battery may be used with system 80. Microprocessor 82 serves as a control unit for system 80. Alternative types of control devices such as digital signal processors may be used as the control unit. System 80 may be turned on and off by an on/off and test switch 86 which also may operate as a push-button for some applications.

Combined environmental and equipment sensor unit 88 may be used to monitor various ambient conditions and conditions of safety equipment associated with a person wearing system 80. Physiological sensor unit 89 preferably monitors one or more physiological conditions of the person wearing system 80. Environmental and equipment sensor unit 88 and physiological sensor unit 89 may provide outputs to comparator circuit 90 of microprocessor 82. Microprocessor 82 then provides signals to visible indicators 92*a* through 92*n* with variable set points to indicate selected equipment, environmental and physiological conditions.

In operation, comparator circuit 90 may provide a signal to microprocessor 82 in response to signals from environmental and equipment sensor unit 88 and physiological sensor unit 89. Microprocessor 82 then provides signals to drive or actuate visible indicators 92*a*–92*n*. Further microprocessor 82 may provide signals to an optional vibration alarm 94 (e.g., mechanical motor, solenoid) and audible alarm 96. Further, microprocessor 82 comprises communication port 98 which may output data to data link port 100 coupled with one or more external interfaces. Data link port 100 may be used, for example, to recover a recorded ambient temperature history or heart rate history or other selected equipment, environmental or physiological information.

Systems 10 and 80 formed in accordance with teachings of the present invention may include software applications and appropriate data bases or other information required to evaluate data associated with one or more critical conditions to determine when action should be taken to prevent injury and/or death to an individual working with a critical condition. System 10 and 80 may be used to identify, monitor and evaluate physiological conditions of a person working in a hazardous or potentially hazardous environment including location and movement or lack of movement of the person. Systems 10 and 80 may be used to identify, monitor and evaluate external environmental conditions and internal environmental conditions.

FIGS. 4, 5, 6 and 7 show one example of a system for alerting personnel of hazardous or potentially hazardous conditions in accordance with teachings of the present invention. System 200 may be easily coupled or removed from safety equipment. System 200 includes sensor unit or sensor assembly 202 having aperture 204 and mounting channel 210 for mounting sensor assembly 202 to safety equipment such as a safety helmet, face shield or face mask. Sensor assembly 202 further includes first indicator 206, second indicator 207 and one or more sensors 205 operable to identify and detect environmental conditions such as ambient temperature. Sensor assembly 202 may include waterproofing such as a high-temperature clear silicone plastic potting compound operable to withstand elevated temperatures while limiting exposure to water and other elements which may be encountered by a person wearing system 200. For some applications sensors 205 may be operable to detect explosive gas mixtures or radiation.

Sensor assembly 202 may be coupled via cable 203 to housing 201 which includes one or more control units, associated electronics and software applications to identify, monitor, evaluate and/or alert safety personnel of hazardous or potentially hazardous conditions. See FIGS. 1, 2 and 3. Housing 201 may include clip 208 operable to be attached to safety equipment such as a helmet, protective clothing, face mask webbing and the like. In one embodiment, housing 201 may be made of a waterproof material operable to withstand high temperatures while minimizing undesired exposure of electronic circuits stored within housing 201. Housing 201 may include high-temperature silicon-rubber seals such as, for example, Viton7 seals developed by Dupont-Dow Elastomers, L.L.C., operable to withstand elevated temperatures while minimizing exposure to water and other elements.

In one embodiment, sensor or sensors 205 may include a thin film resistance temperature detector (RTD) operable to be positioned within an opening or cavity associated with sensor assembly 202. Such RTDs may be formed from platinum or other suitable materials. The RTD may include a front surface and a rear surface operable to be placed within an ambient environment. System 200 may include an Atmel AT90LS4434 processor with an integrated analog-to-digital function. The processor may be used to compare a precision reference resistor (not expressly shown) to one or more RTD sensors 205. The comparisons do not generally depend on battery supply voltage or temperature of the processor. Only relative resistance of sensors 205 and the reference resistor are compared. The sensitivity of a typical analog-to-digital conversion process may be approximately one count for each degree Fahrenheit change. The repeatability of measurements may be approximately +/−0.5 counts. Imbedded software in the processor's Flash ROM may compare A/D values to each temperature threshold or set point and appropriately control indicators 206 and 207. The reference resistor may be a precision metal-film resistor with a 0.1% accuracy, very low temperature coefficient and long-term stability. (For example, Panasonic: ERA-3YE-Bxxx, 1.5K Ohms)

For some applications, sensor 205 may include a thin-film ceramic device (Minco S247PFY, 1.0K Ohms at 0 Centigrade). Typical specifications include:

Material: Platinum film on a thin aluminum oxide substrate with a fused-glass cover.

Tolerance: 0.12% at 0 degree Centigrade (C.) (About +/−0.8 degrees Fahrenheit (F.).

Sensitivity: RTC=0.00385 Ohms/Ohm/degree C. (About 0.2% per degree F.).

Repeatability: +/−0.1 degree C. or better.

Stability: Drift less than 0.1 degree C. per year.

Temperature range: −70 to +600 degrees C.

Vibration: Withstand 20 Gs minimum at 10 to 2000 Hz.

Shock: Withstand 100 Gs minimum sine wave shock for 8 milliseconds.

The calculated accuracy of system 200 may be approximately four (4) degrees Fahrenheit, including reference resistor and sensor tolerances. The overall accuracy of system 200 may be rated at +/−10 degrees Fahrenheit.

Sensor assembly 202 may include a cavity or opening at or near the tip or end of sensor assembly as illustrated in FIGS. 4 and 5 to accommodate one or more sensors 205. As such, sensor assembly 202 may provide an air flow path operable to allow ambient air to flow through the cavity to exposed sensor or sensors 205 and associated thin film elements. Sensors 205 may be positioned away from a face mask or face shield (not shown) and within an ambient environment such that system 200 may consistently and accurately sense ambient temperatures.

FIG. 5 shows a rear view of sensor assembly 202 illustrated in FIG. 4. Sensor assembly 202 includes a plurality of screws 209 to couple the front and rear surfaces of sensor assembly 202 with each other. Though not illustrated, the front and rear surfaces may be realized as a one-piece molded unit which may not require use of screws 209. Aperture 204 and mounting channel 210 may be operable to mount sensor assembly 202 to various types of safety equipment. Sensor assembly 202 also includes first indicator 206 and second indicator 207 operable to provide visible indications of various conditions such as temperature, hazardous materials, explosive mixtures, and/or radioactive nuclides detected by system 200.

In one embodiment, sensor assembly 202 may include rounded surfaces which may reduce snagging or jarring of sensor assembly 202 during use. Sensor assembly 202 may include a front surface made of a dark material and a rear surface made of an optically transmittable or substantially clear material which may include a micro-prism high-visibility surface finish to enhance visibility of indicators 206 and 207. Indicators 206 and 207 may also include optical transmission channels operable to transmit light to exterior surface of indicators 206 and 207. In this manner, a wearer may view indicators 206 and 207 when illuminated, while other personnel proximal to the wearer may also view illuminated indicators 206 and 207 via respective optical transmission channels. For example, indicators 206 and 207 may be visible to other firefighters from the front of sensor assembly 202 by illuminating indicators 206 and 207 which include optical transmission channels or light conducting paths to exterior portions of indicators 206 and 207 as illustrated in FIG. 4. As such, both the wearer and other personnel may view an indication representing a critical condition.

System 200 preferably includes a control unit disposed within housing 201 with electronics operable to communicate a signal associated with environmental and/or physiological conditions such as equipment temperature, ambient temperature or heart rate. Cable 203 may be communicatively coupled between sensor assembly 202 and housing 201. In one embodiment, sensor 205 may be operable as an "active" temperature sensor to provide continues monitoring of ambient temperature by sampling on a periodic basis (e.g. every four seconds, eight seconds, etc.). In this manner, a detected ambient temperature condition may then be used to determine if an operating mode of system 200 should be altered. For example, system 200 may be operable to sample an ambient temperature condition every eight seconds. Upon detecting a selected ambient temperature condition the sample rate may be increased (e.g. increase sampling from once every eight seconds to four times per second). As such, system 200 may be operable to satisfactorily monitor ambient temperature conditions while conserving energy of a power source, such as a battery, associated with system 200.

System 200 may be operable to provide a wearer an indication of selected environmental conditions. For example, first indicator 206, operable as a green indicator, may be continuously illuminated during a safe temperature condition. Upon system 200 determining an unsafe ambient air temperature condition or other critical condition, associated control unit 201 may provide a signal to second indicator 206, operable as a red indicator, in response to the hazardous or potentially hazardous condition. For example, a hazardous or potentially hazardous condition may include an ambient temperature of five hundred degrees Fahrenheit. As such, system 200 may continuously illuminate second indicator 206 operable as a red indicator.

FIG. 6 is a side view showing system 200 coupled to a face mask according to one embodiment of the present invention. System 200 may be coupled to a face mask 221 of self contained breathing apparatus 230. Sensor assembly 202 may be coupled to front portion of face mask 221 such that a wearer may view indicators 206 and 207 of sensor assembly 202. Housing assembly 201 may include on/off and test button 213 for checking operating status of system 200 and may be operable to perform a battery test, determine battery life, perform system diagnostics, etc. Housing assembly 201 may be coupled to a face mask webbing 220 using clip 208 such that housing assembly 201 may be covered by a helmet or other safety headgear (not expressly shown).

Housing assembly 201 may be coupled to sensor assembly 202 via cable 203 which may be positioned behind or along a portion of face mask 221 and face mask webbing 220. Cable 203, sensor assembly 202 and housing assembly 201 are preferably made of high quality materials capable of withstanding high temperature levels for extended periods of time (e.g. greater than five hundred degrees Fahrenheit for several minutes). System 200 advantageously allows a wearer to position system 200 such that, during use, system 200 may be comfortably worn in addition to being easy to attach or remove as required. System 200 provides one example of a personal situation awareness device which may be used with different types of safety equipment without having to be permanently mounted to such safety equipment.

FIGS. 8, 9, 10A and 10B show various alternative fastener systems which may be used to releasably attach all or portions of a personal situation awareness device and other safety systems with a face mask or other safety equipment in accordance with teachings of the present invention. For some applications face mask 221 may include frame 223 formed from metal alloys or other materials satisfactory for use in a high temperature, fire fighting environment. The dimensions associated with mounting channel 210 of sensor assembly 202 are preferably selected to be compatible with corresponding dimensions of frame 223. The dimensions and configuration of mounting channel 210 may be modified to accommodate various types of sensor assemblies, face masks and other types of safety equipment.

FIG. 8 is a schematic drawing showing an exploded, isometric view of a fastener system satisfactory for use in attaching sensor assembly or sensor unit 202 with face mask 221 in accordance with teachings of the present invention. For the embodiment shown in FIG. 8, frame 223*a* may include enlarged portion 224*a* which is formed as an integral component of frame 223*a*. For the embodiment shown in FIG. 8, threaded post or threaded stud 226 may be attached to enlarged portion 224 and project therefrom. Various types of mechanical fasteners other than threaded post 226 may be satisfactorily mounted on enlarged portion 224*a*.

The dimensions associated with aperture 204 of sensor assembly 202 and threaded post 226 are preferably selected to be compatible with each other to allow sensor assembly 202 to be releasably attached to or mounted on face mask 221. Threaded washer 222 may be used to releasably secure sensor assembly 202 with threaded post 226. For the embodiment shown in FIG. 8 threaded washer 222 preferably includes two small holes, 228 and 229, which may be engaged by an appropriately sized tool (not expressly shown) to secure threaded washer 222 with threaded post 226. Various types of nuts and other threaded fasteners may also be used.

Figure 9:
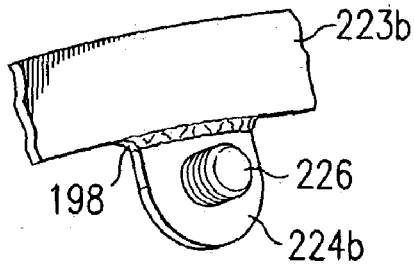
FIG. 9 is a schematic drawing showing an isometric view of another example of a fastener satisfactory for attaching a sensor assembly incorporating teachings of the present invention with a face mask.

FIG. 9 is a schematic drawing showing another example of a fastener assembly satisfactory for use in attaching a sensor unit or a sensor assembly with a face mask in accordance with teachings of the present invention. For the embodiment shown in FIG. 9, frame 223*b* may have approximately the same dimensions and configuration as frame 223*a*. Enlarged portion 224*a* and 224*b* may also have approximately the same dimensions and configuration. However, for the embodiment shown in FIG. 9 enlarged portion 224*b* may be attached with associated frame 223*b* using various types of bonding techniques. For example, frame 223*b* and enlarged portion 224*b* may be attached to each other by forming weld 198. For other applications a high temperature adhesive bond (not expressly shown) may be satisfactorily used to securely engage enlarged portion 224*b* with frame 223*b*. Threaded post or threaded stud 226 extends from enlarged portion 224*b* for use in releasably attaching a sensor assembly or sensor unit thereto in accordance with teachings of the present invention.

Figure 10A:
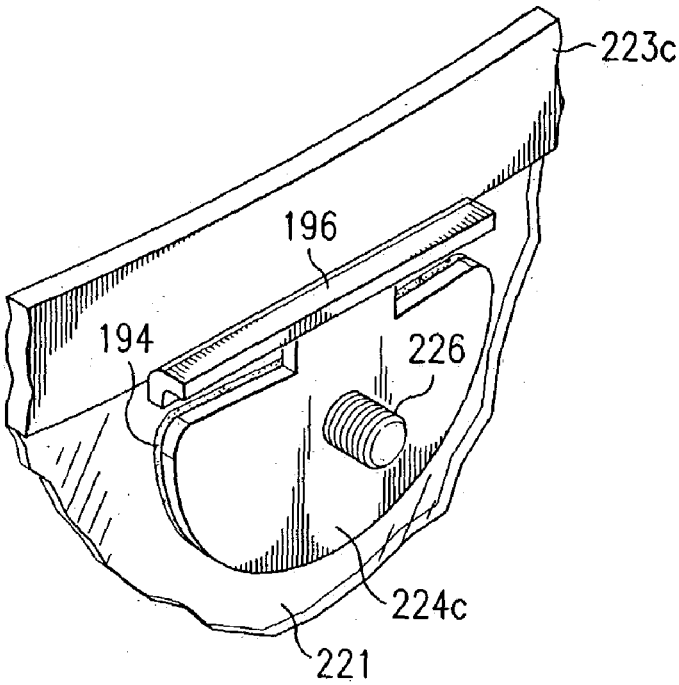
FIGS. 10A and 10B are schematic drawings showing an isometric view and a side view with portions broken away of an adapter which may be adhesively bonded with a face mask to releasably attach a sensor unit or sensor assembly with the face mask in accordance with teachings of the present invention.
Figure 10B:
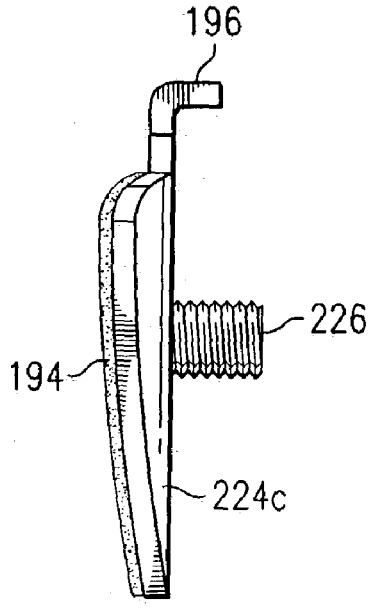

FIGS. 10A and 10B are schematic drawings which show still another fastener system satisfactory for use in attaching a sensor unit or sensor assembly with a face mask or other types of safety equipment in accordance with teachings of the present invention. For the embodiments shown in FIGS. 10A and 10B enlarged portion 224*c* may be securely mounted on face mask 221 using various types of high temperature adhesives. The embodiment shown in FIGS.

10A and 10B eliminates the requirement to form enlarged portion 224*c* as an integral component of frame 223*c* or to directly attach enlarged portion 224*c* with frame 223*c*.

Enlarged portion 224*c* may be formed from various types of metal alloys and/or high temperature polymeric materials satisfactory for use with a face mask associated with fire fighting equipment. Enlarged portion 224*c* preferably includes a generally curved or arcuate portion compatible with the exterior surface of face mask 221. See FIG. 10B. Threaded fastener or stud 226 may be formed on or attached to enlarged portion 224*c* using various techniques which are well known in the art. For the embodiment shown in FIGS. 10A and 10B, enlarged portion 224*c* preferably includes upper support 196 selected to be compatible with exterior dimensions of sensor assembly or sensor unit 202. High temperature adhesive bond 194 is preferably formed between the exterior of face mask 221 and an adjacent interior surface of enlarged portion 224*c*. Various types of adhesive materials such as 3M Corporation's Type 5952 adhesive foam sheets may be satisfactorily used to form adhesive bond 194. 3M Corporation's adhesives numbered 4611, 4646 and 4655 may also be used for form bond 194.

The dimensions of enlarged portions 224*a*, 224*b* and 224*c* may be substantially modified to accommodate various types of face masks, face shields and other types of safety equipment. Also, the dimensions and configurations of enlarged portions 224*a*, 224*b* and 224*c* may be modified to accommodate various types of personal situation awareness devices. For some applications housing assembly 201 and sensor assembly 202 may be combined as a single unit (not expressly shown) and mounted on enlarged portion 224*a*, 224*b* or 224*c*.

Figure 11:
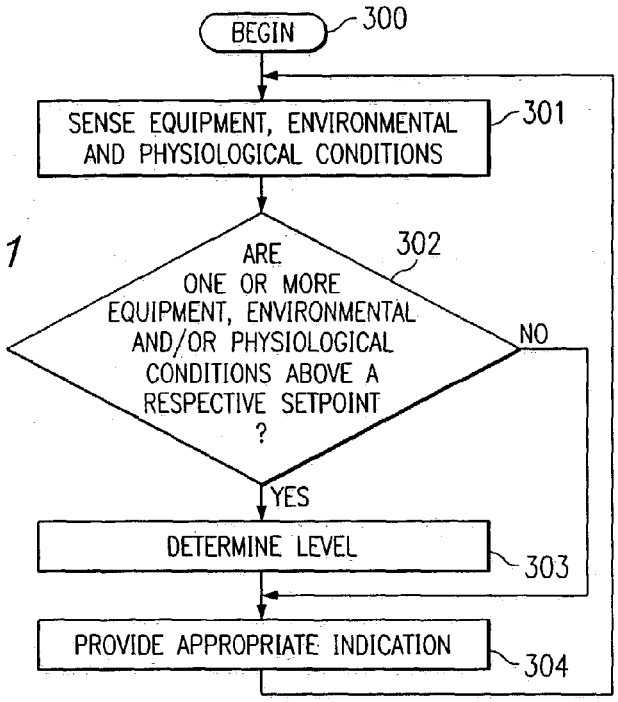
FIG. 11 is a flow chart showing a method to alert safety personnel of hazardous or potentially hazardous conditions according to another embodiment of the present invention.

FIG. 11 is a flow chart showing one method to alert personnel of hazardous or potentially hazardous conditions according to another embodiment of the present invention. The method may be used by systems 10, 80, 200, 500 and/or other safety system incorporating teachings of the present invention. The method begins generally at step 300. At step 301 equipment, environmental and physiological conditions may be sensed using various sensors such as a resistive temperature device (RTD), thermistor, infra-red (IR) sensor, air pressure, air flow rate monitor, heart rate detector, blood pressure sensor, or other sensors operable to sense selected equipment, environmental and physiological conditions. After sensing equipment, environmental and physiological conditions, the method determines at step 302 if the equipment, environmental and physiological conditions are greater than a respective set point.

After determining if equipment, environmental and physiological conditions are greater than one of the set points, the method proceeds to step 303 where the method determines the level of the measured equipment, environmental and/or physiological condition. The method, operable to determine equipment, environmental and physiological conditions, may provide several different types of indications depending on the determined conditions as they relate to, for example, safety procedures. The method may be operable to determine a plurality of equipment, environmental and physiological conditions or thresholds to provide various indications based upon the respective set points. For example, one group of set points may include an ambient air temperature between one hundred forty degrees Fahrenheit and two hundred degrees Fahrenheit; an ambient air temperature above two hundred degrees Fahrenheit for a period of eight seconds; an ambient air temperature between four hundred degrees Fahrenheit and five hundred degrees Fahrenheit; an ambient air temperature above five hundred degrees Fahrenheit for eight seconds; or a plurality of other air ambient temperature conditions as needed.

Upon determining a level at step 303, the method proceeds to step 304 where the method may provide an appropriate indication for the determined level. For example, the method may determine an ambient air temperature condition of two hundred degrees Fahrenheit for a period of eight or more seconds. As such, the method may continuously illuminate indicator 206 which may be operable as a green light emitting diode or a miniature incandescent light. In another embodiment, an ambient air temperature condition between four hundred degrees Fahrenheit and five hundred degrees Fahrenheit may be determined. As such, first indicator 206 operable as a green Indicator may be continuously illuminated and second indicator 207 operable as a red indicator may be periodically illuminated (e.g. blinking) thereby providing an overall indication reflective the associated determined level.

Upon providing an appropriate indication at step 304, the method proceeds to step 301 where the method senses additional equipment, environmental and physiological conditions. In this manner, the method provides for sensing equipment, environmental and physiological conditions determining a level and providing an appropriate indication based upon the sensed conditions to ensure that safety personnel have current indications of any hazardous or potential hazardous condition.

In one embodiment, a system deploying the method of FIG. 11 may be operable to sample selected equipment, environmental and physiological conditions. The system may be operable in a mode which senses temperature at a periodic rate based upon a determined temperature level. For example, the system may sense a selected temperature every eight seconds until a temperature level of one hundred degrees Fahrenheit is sensed. As such, the system may alter the operating mode to sense the same temperature four times per second. In this manner, effective life of an associated battery may be preserved during what may be "non-critical" temperature conditions to extend the amount of time the system may be used.

Figure 12:
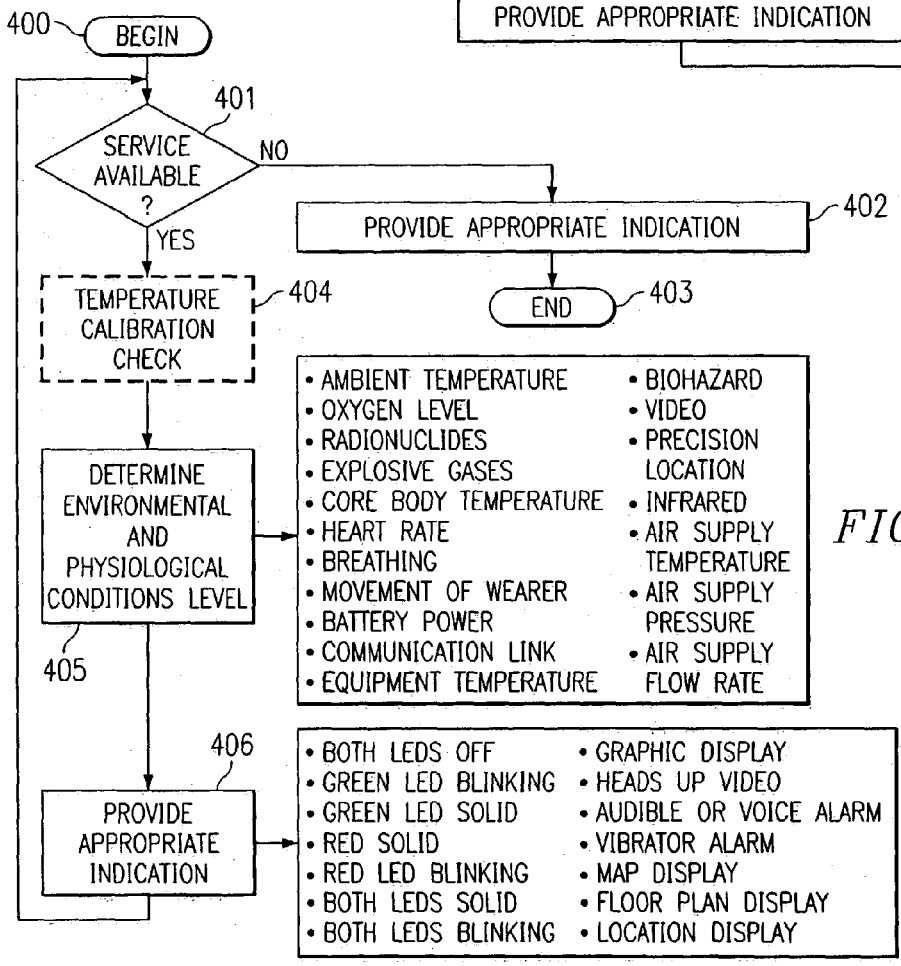
FIG. 12 is a flow chart showing a method to identify, monitor, evaluate and alert personnel of hazardous or potentially hazardous conditions according to teachings of the present invention.

FIG. 12 is a flow chart of a method for activating a system or device to alert a user of hazardous or potentially hazardous conditions according to one embodiment of the present invention. The method may be deployed by systems 10, 80, 200, 500 and/or any other system operable to deploy the method illustrated in FIG. 12. Reference numbers, components, and elements of system 200 of FIG. 4 are used in an exemplary form but are not intended to limit the applicability of the method of FIG. 12.

The method begins generally at step 400. At step 401, the method determines if service is available for measuring selected equipment, environmental and physiological conditions using a system or device such as system 200. For example, a voltage regulator (not expressly shown) associated with system 200 may determine the amount of power available for operating system 200. For example, a "power-consumption-to-operating-time" ratio may be provided for determining service availability. In one embodiment, fifteen minutes of service must be available prior to providing service for a system. If an appropriate amount of operating time or service is not available, the method may deny service and proceed to step 402 where an appropriate indication may be provided to a user. For example, both first indicator 206 and second indicator 207 may blink three times indicating that service is not available due to a weak battery or power source.

In one embodiment, the method at optional step 404 may perform a diagnostic check of an associated system prior to providing service. For example, the method may perform a diagnostic check of electronics and associated hardware prior to allowing service. One embodiment may also allow a wearer to initiate a system check or a battery test prior to using the system.

Figure 13:
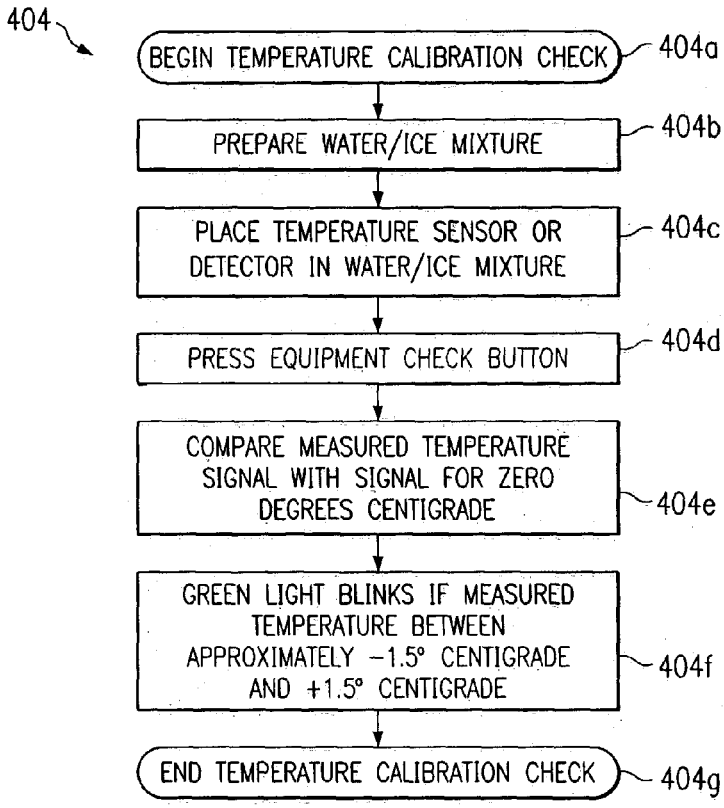
FIG. 13 is a block diagram showing one method to perform a calibration check in accordance with teachings of the present invention.

FIG. 13 shows one example of a method to perform a calibration check at step 404. Other types of diagnostic checks may be performed in accordance with teachings of the present invention. An associated control unit may detect when an associated "equipment check" or "test" button is held down. When the button is held, the control unit and associated software measure the temperature of an ice and water mixture and compare the measurement to a reference value for zero degrees Centigrade. If the measurement is close to zero, the unit is calibrated and the control unit may blink one or more green lights.

To perform a calibration check in the field, the method shown in FIG. 13 may start with step 404*a*. At step 404*b*, a mixture of finely crushed ice and water may be prepared in an insulated container, such as a plastic foam cup. Sensors 205 may be immersed in the ice/water mixture at step 404*c* with the tip of sensor 205 near the center of the ice. After 5 minutes the temperature will stabilize. The test button or check button is pressed and held at step 404*d*. The associated system at step 404*e* may then compare measured temperature signals from sensor 205 with a reference signal corresponding with zero degrees Centigrade or thirty-two degrees Fahrenheit. At step 404*f*, both indicator lights 206 and 207 will blink three times and then the green light will blink if the system is satisfactorily calibrated. The green light will continue to blink at step 404*f* as long as the test button is held and the temperature of sensor 205 remains between thirty and thirty-four degrees Fahrenheit. At step 404*g*, the test button may be released and the calibration check will end.

After determining that service is available at step 401 and performing an optional diagnostic check at step 404, the method may then proceed to step 405 where the method determines the value of selected environmental and physiological conditions. For example, system 200 having sensor assembly 202 may sense a temperature using sensors 205. Upon sensing the temperature, a temperature level may then be determined based upon the sensed temperature. For example, a comparator may be used in association with sensor assembly 202. A converted signal representing the sensed temperature may then be used to determine the temperature level.

In one embodiment, several temperature levels or thresholds may be used to determine a temperature level. For example, one embodiment may include determining an ambient air temperature of one hundred forty degrees Fahrenheit; between one hundred forty degrees Fahrenheit and two hundred degrees Fahrenheit; greater than two hundred degrees Fahrenheit for eight seconds; between four hundred degrees Fahrenheit and five hundred degrees Fahrenheit; and greater than five hundred degrees Fahrenheit for eight seconds. Other temperature levels or thresholds may be used in association with the method of FIG. 12 as desired.

Upon determining a temperature level, the method may proceed to step 406 where the method provides an appropriate indication for the determined level. For example, system 200 having first indicator 206 operable as a green indicator and second indicator 207 operable as a red indicator may be used to provide an appropriate indication of the determined temperature level or temperature condition at step 405. As such, the method may use several combinations for illuminating first indicator 206 and second indicator 207. For example, the method may not illuminate either indicator for a temperature of less than one hundred and forty degrees Fahrenheit; periodically illuminate (e.g. blinking) first indicator 206 for a temperature level between one hundred forty degrees Fahrenheit and two hundred degrees Fahrenheit; continuously illuminate first indicator 206 for a temperature level of greater than two hundred degrees Fahrenheit for eight seconds; continuously illuminate first indicator 206 and periodically illuminate (e.g. blinking) second indicator 207 for a temperature level between four hundred degrees Fahrenheit and five hundred degrees Fahrenheit; or continuously illuminate first indicator 206 and second indicator 207 for a temperature of greater than five hundred degrees Fahrenheit for eight seconds.

Upon providing an appropriate indication, the method proceeds to step 401 where the method determines another temperature level. In this manner, several different temperature levels and associated indications may be determined and provided by the method of FIG. 12 as needed or required while providing indications of ambient air current temperature conditions to safety personnel.

Figure 14:
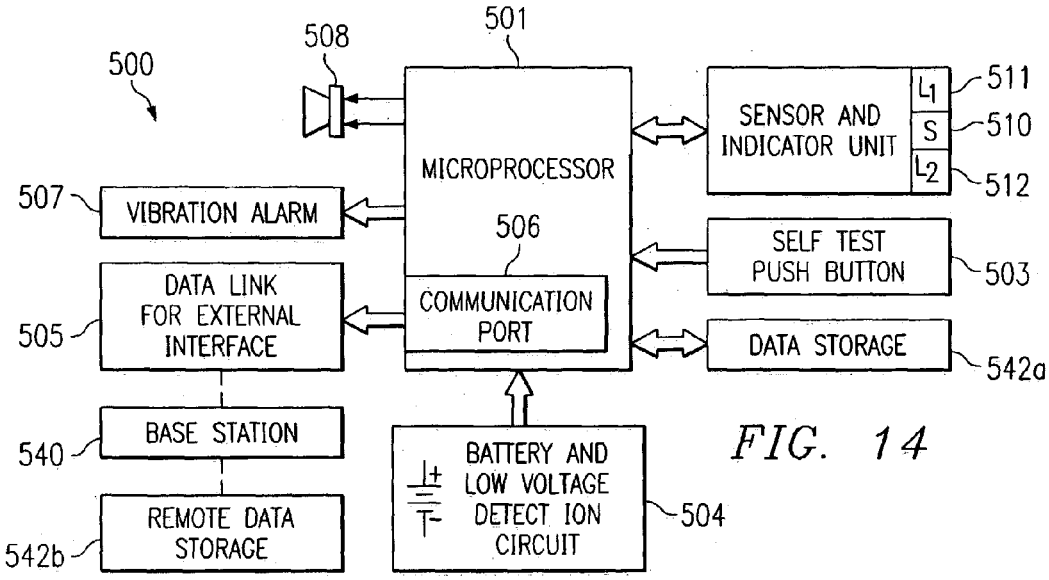
FIG. 14 is a block diagram of a system operable to identify, evaluate, monitor and alert personnel of hazardous or potentially hazardous conditions according to another embodiment of the present invention.

FIG. 14 is a block diagram of a system for alerting safety personnel of hazardous or potentially hazardous conditions according to another embodiment of the present invention. In the embodiment of FIG. 14, system 500 may include microprocessor 501 operable to receive power from battery and low voltage detection circuit 504.

One alternate and acceptable implementation for microprocessor 501 would be to use multiple digital signal processors, microprocessors and/or microcontrollers as the control unit for system 500. For example, one microprocessor might be a digital signal processor (DSP) for use in conditioning certain sensor signals, while a second general-purpose microprocessor or microcontroller might control the overall sequencing and display of events for the system.

In one embodiment, system 500 may provide a battery life of greater than four months at room temperature thereby reducing the need for replacing a battery on a frequent basis. Microprocessor 501 may serve as a control unit for system 500, which may include alternate types of control devices as mentioned above. Service of system 500 may be automatically determined by processor 501 or may also be determined by operating self test push-button 503. Sensor unit 502 may include first indicator 511, second indicator 512 and temperature sensor 510. Sensor unit 502 may be operable to measure temperature or any other desired environmental condition or physiological condition and may provide an output to a comparator circuit or A/D converter operably associated with microprocessor 501. Microprocessor 501 may also be operable to provide signals to first indicator 511 and second indicator 512.

System 500 may further include vibration alarm 507 (e.g., mechanical motor, solenoid) and audible alarm 508 operable to provide an indication based upon a critical condition. Further, microprocessor 501 may include communication port 506 which is operable to output data to data link 505 to connect or communicate between system 500 and other external systems such as command center or base station 540. Data link 505 may use various communication technologies such as wireless, infrared, laser, fiberoptic, acoustic or cable. Data link 505 may also be used to communicate with another person wearing a second system 500. As such, a recorded temperature history or other pertinent information may be obtained by an external device operable to communicate with system 500 via data link 505.

During use, service or availability of system 500 may be determined by microprocessor 501 through accessing battery and low voltage detection circuit 504. Upon determining if sufficient voltage or battery life is available, system 500 may determine the value of selected environmental and physiological conditions using sensor unit 502 and multiple sensors 510. Microprocessor 501 may determine an operating mode for system 500 by sampling environmental and physiological conditions using sensor unit 502 and providing an operating mode based upon one or more selected conditions. For example, system 500 may sample or sense ambient temperature every eight seconds for temperatures less than one hundred forty degrees Fahrenheit, and four times per second for temperatures greater than one hundred forty degrees. As such, energy may be conserved at lower temperatures thereby extending the usable life of system 500's battery.

System 501, upon sensing a temperature with sensor unit 502, may then determine an ambient air temperature condition and provide an appropriate output. For example, if a temperature between one hundred forty degrees Fahrenheit and two hundred degrees Fahrenheit is determined, system 500 may provide one of a plurality of outputs available to system 500 such as using vibration alarm 507, audible alarm 508, indicators 511, 512. As such, system 500 provides an efficient system for providing personnel an indication of current ambient air temperature conditions. Indicators 511 and 512 may be light emitting diodes, liquid crystal displays, portions of a head up display or any other appropriate visual display for communicating information from system 500 to a wearer or user.

One Example of Communication Options for Two LED's

| | RED OFF | RED BLINKING | RED SOLID |
|---|---|---|---|
| OFF | | | |
| GREEN BLINKING | | | |
| SOLID | | | |

In this example, two LED's are used to display up to nine distinct conditions.

For some environments, such as a fire in a large building or other type of structure, ambient air temperature conditions may vary significantly from one location to the next. Ambient air temperature may also vary significantly, when a firefighter moves between a standing position and a crouched position. Also, a relatively quick response from indicators 511 and 512 may be desirable when a firefighter moves between safe ambient air temperature conditions and dangerous ambient air temperature conditions. For such applications, indicators 511 and 512 of system 500 may be operated as follows.

For safe ambient air conditions or other safe operating conditions, indicators 511 and 512 would both be green. When ambient air conditions or other environmental and/or physiological conditions are dangerous, both indicators 511 and 512 will preferably be red. When ambient air temperatures or other environmental and/or physiological conditions are rising, indicators 511 and 512 will preferably remain solid. When ambient air temperatures or other environmental and/or physiological conditions are decreasing, indicators 511 and 512 will preferably be blinking. For example, as a firefighter moves through a building with safe, but increasing ambient air conditions, both indicators may be solid green. If safe ambient air temperatures are decreasing, indicators 511 and 512 may both be green and blinking. In a similar manner, if the firefighter is in an ambient temperature condition above established limits and the temperature is continuing to increase, indicators 511 and 512 may be red and solid. If ambient air temperature conditions are above an established safety limit, but decreasing or cooling, both indicator 511 and 512 may be red and blinking. The response time to increasing or decreasing temperature would be relatively quick, often less than one (1) second. Therefore, when the change in indicator 511 and 512 from solid to blinking or blinking to solid would quickly advise a firefighter that the ambient temperature conditions are changing.

Personal situation awareness devices and other systems incorporating teachings of the present invention may have the following components, features and characteristics.

Temperature Encoders

An electronic thermometer that tells firefighters about the temperature of the environment. Critical temperature thresholds may be indicated with a system of green and red lights in the periphery of their vision.

Measures a combination of the air temperature and radiant heat flux to predict the surface temperature trend at the mask faceplate.

Thermal sensor element is a thin-film platinum RTD on a thin ceramic chip. It can predict, by up to 30 seconds, the temperature the firefighter's gear will soon experience.

Measures air supply temperature to a face mask.

Provide firefighters information about critical conditions inside a structure fire.

Provide a training tool to allow certain basic training exercises to be easily repeated without having to travel to and go into a burn-box trainer, saving cost, time, and potential equipment damage and personnel injury.

EXAMPLE 1 OF INDICATED CONDITIONS

| Light Status | Department Determined Policy/Procedures |
|---|---|
| No Lights | Less than 125 Fahrenheit. Victims can survive. Proceed normally. |
| Blinking Green | You are in a warm environment and your fire protective gear should be safe. Unprotected victims can survive only a few minutes. Cool the area. Proceed normally. |
| Solid Green | You are depending on the thermal barrier of your protective clothing but it is safe to continue. Most turnouts are rated for 10 or 12 minutes of protection at 212° F. Steam burns can occur. Victims cannot survive without protection. Cool the environment. Get lower. |
| Solid Green, Blinking Red | Your gear is near its protection limit. Get lower. Cool the area immediately or move. Flashover is possible. |

-continued

| Light Status | Department Determined Policy/Procedures |
|---|---|
| Solid Green, Solid Red | The Integrity of your protective gear is at risk. You are in serious jeopardy. Flashover is likely. Evacuate Immediately. |

EXAMPLE 2

| Light Status | Department Determined Policy/Procedures |
|---|---|
| Two Lights Both Green | You are in a safe environment and equipment conditions are below preselected safe limits. Proceed normally. |
| Two Lights Both Red | Ambient conditions or equipment conditions are above preselected safe limits. Victims may not survive without protection. Cool the environment. Get lower. |
| Both Lights Blinking (Green or Red) | Air temperature or other hazardous condition decreasing. |
| Both Lights Solid (Red or Green) | Air temperature or other hazardous condition increasing. |

Construction

Molded high-temperature plastics, involving the same materials used to make firefighter's masks and helmets.

Functional Characteristics

Calculates lag time between temperature of environment and temperature of safety equipment.

Calculates heat sink characteristics of safety equipment.

Calculates temperature gradient between external environment and safety equipment.

Calculates temperature limits based on lag time between external environment temperature and temperature of equipment.

Monitors and evaluates physiological characteristics (temperature, heart rate, breathing) of the user.

Adapter clip for attachment with face mask or with other types of safety equipment.

Multiple sensors such as temperature, infrared, acoustic, pressure, oxygen or other gases.

Embedded in molded plastic to conform with various types of safety equipment.

Thermal Encoder with Data Recording and Retrieval Capability

Analysis software receives, displays, coordinates, compares and analyzes.

A maintenance tool for product life cycle.

Number of exposures to critical environment

Monitor limit on number of equipment cycles

Time tracks for download allows for simultaneous comparison of multiple units exposed to a situation.

Records time above selected thresholds.

Real Time Telemetry.

Two-way data transmission and reception

Heads Up displays of information

Motion stop sensor

Time stamp

Analysis software and analysis tools for command station.

Real time telemetry with personnel tracking and hazard plotting.

Sensors, transmitters, a receiver that tracks environmental conditions, physiological conditions, locations and movements.

Forward looking infrared Heads up display, etc.

Software and hardware that collects, organizes, interprets, analyses, compares, alerts, records and communicates (send/receive) with remote locations and adjacent personnel.

Although the present invention has been described in detail, it should be understood that various changes, substitutions and alterations may be made hereto without departing from the spirit and scope of the invention as defined by the appended claims.

What is claimed is:

1. A system for identifying, monitoring and evaluating environmental and physiological conditions comprising:

a control unit stored within a housing, the control unit operable to: communicate signals associated with environmental and physiological conditions;

determine whether an amount of power remaining in a system power source is sufficient to power the system for a predetermined amount of time; and produce a visual low power warning if the amount of power remaining in the system power source is not sufficient to power a wearable temperature monitoring device for the predetermined amount of time;

an environmental sensor communicatively coupled to the control unit, the environmental sensor operable to be positioned within an ambient environment;

an equipment sensor communicatively coupled to the control unit, the equipment sensor operable to detect at least one condition of safety equipment associated with a person wearing the system; and an indicator operable to provide an indication representing a hazardous or potentially hazardous condition.

2. The system of claim 1, further comprising:

a physiological sensor communicatively coupled to the control unit; and the physiological sensor unit operable to detect at least one physiological condition of the person wearing the system.

3. A system for identifying, monitoring, evaluating and alerting a wearer of at least one critical condition comprising:

a control unit stored within a housing, the control unit operable to communicate signals associated with environmental and physiological conditions;

an environmental sensor communicatively coupled to the control unit, the environmental sensor operable to be positioned within an ambient environment;

an equipment sensor communicatively coupled to the control unit, the equipment sensor operable to detect and monitor at least one condition of safety equipment associated with the person wearing the system;

a physiological sensor communicatively coupled to the control unit, the physiological sensor unit operable to detect and monitor at least one physiological condition of a person wearing the system; and an indicator operable to provide a first visual signal in response to a sensed environmental condition exceeding a first threshold for a first length of time and a second visual signal in response to the sensed environmental condition exceeding a second threshold for a second length of time.

4. The system of claim 3, further comprising the equipment sensor and the environmental sensor combined into a single unit.

5. A method for monitoring and evaluating environmental conditions and physiological conditions of a person exposed to hazardous or potentially hazardous conditions, comprising:

performing a field check prior to use;

sensing at least one environmental condition using at least a first sensing device;

sensing at least one physiological condition using at least a second sensing device;

monitoring and evaluating variable relationships between environmental conditions and physiological conditions to prevent serious injury or loss of life from overexposure to a critical condition;

determining an amount of power available to operate the sensing devices;

associating an operating time to the determined amount of power; and altering a mode of operation in response to the associated operating time.

6. A method for monitoring and evaluating environmental conditions and physiological conditions of a person exposed to hazardous or potentially hazardous conditions, comprising:

performing a field check prior to use;

sensing at least one environmental condition using at least a first sensing device;

sensing at least one physiological condition using at least a second sensing device;

monitoring and evaluating variable relationships between environmental conditions and physiological conditions to prevent serious injury or loss of life from overexposure to a critical condition;

providing a solid light to indicate that the level associated with the at least one combination of sensed environmental and physiological conditions is increasing; and activating a blinking light to indicate that the level associated with the at least one combination of sensed environmental and physiological conditions is decreasing.

7. A method to conduct a diagnostic check of a safety system used to monitor and evaluate environmental conditions associated with a person wearing the safety system, comprising:

initiating a calibration check of at least one temperature sensing device associated with the safety system;

placing the at least one temperature sensor in a mixture of water and ice;

measuring a temperature signal from the at least one temperature sensor;

comparing the measured temperature signal with a reference signal corresponding with zero degrees Centigrade;

providing a first visual indication if the measured temperature signal corresponds approximately with the reference signal for zero degrees centigrade; and providing a second visual signal if the measured temperature signal exceeds the reference temperature signal by a selected value.

8. A personal situation awareness system operable to be coupled to a wearer for identifying, monitoring and evaluating hazardous or potentially hazardous conditions comprising:

a control unit operable to be coupled to the wearer having electronics operable to communicate signals associated with the at least one hazardous or potentially hazardous condition;

a physiological sensor mounted on a mechanical arm configurable to keep the sensor within a filed of view of the wearer, said physiological sensor operable to measure and evaluate at least one physiological condition of the wearer; and a first indicator and second indicator operable to display within the field of vision of the wearer an indication representing the at least one hazardous or potentially hazardous condition.

9. The system of claim 8 further comprising:

an environmental sensor operable to be positioned with an ambient environment; and the environmental sensor operable to evaluate the operating condition of safety equipment associated with the wearer.

10. The system of claim 9 further comprising the control unit operable to transmit environmental and physiological information to a base station.

11. The system of claim 9 further comprising the control unit operable to transmit real time information and historic information concerning identification and location of the safety system, environmental information and physiological information to a base station.

12. A method to conduct an automatic field diagnostic check of a safety system used to evaluate environmental or physiological conditions associated with a person wearing the safety system, comprising:

initiating a calibration check of at least one sensor element associated with the safety system in response to an action of the person wearing the safety system;

providing a standard environment for the at least one sensor element during the calibration check;

measuring a signal from the at least one sensor element during the calibration check;

comparing the measured value of the at least one sensor element being tested to an expected standard value;

providing a first indication if all of the measured values are within acceptable limits; and providing a second indication if any of the measured values are outside of acceptable limits.

13. A temperature warning system, comprising:

a temperature indicator operable to provide visual signals in response to a detected temperature;

a temperature sensor operable to detect temperature; and a control unit in communication with the temperature indicator and the temperature sensor, wherein the control unit performs operations comprising:

tracking exposure times for detected temperatures;

causing the temperature indicator to provide a first visual signal in response to detected temperatures exceeding a first threshold temperature for a first predetermined exposure time threshold; and causing the temperature indicator to provide a second visual signal in response to detected temperatures exceeding a second threshold temperature for a second predetermined exposure time threshold.

14. A method of automatically monitoring safety conditions, the method comprising:

fixing a visual temperature indicator in a field of view of safety gear;

detecting temperatures with a temperature sensor attached to the safety gear, as the safety gear and the attached temperature sensor move through an environment;

in response to detecting temperatures that exceed different threshold temperatures, automatically causing the visual temperature indicator to provide different visual signals corresponding with the different threshold temperatures;

recording temperature information in a computer memory, based on the detected temperatures; and recording positioning information in the computer memory, such that the recorded positioning information and the recorded temperature information can be used to map temperature gradients in the environment.

15. A method of controlling a wearable temperature monitoring device and visual temperature indicator that uses a portable power source, the method comprising:

in response to manual activation of the wearable temperature monitoring device, detecting an amount of power available in the portable power source;

automatically determining whether the detected amount of power suffices to power the wearable temperature monitoring device and the visual temperature indicator for a predetermined amount of time;

in response to determining that the detected amount of power suffices to power the wearable temperature monitoring device for the predetermined amount of time, detecting ambient temperature and providing a visual signal in response to the detected ambient temperature exceeding a threshold temperature; and in response to determining that the detected amount of power does not suffice to power the wearable temperature monitoring device for the predetermined amount of time, automatically producing a visual low power warning.

16. A wearable safety device that monitors ambient temperature conditions for a person wearing safety gear that provides visual signals of corresponding temperatures in a field of view, the wearable safety device comprising:

a temperature indicator disposed on an arm;

the arm operable to keep the temperature indicator within the field of view provided by the safety gear;

a temperature sensor operable to detect ambient temperature;

a control unit in communication with the temperature indicator and the temperature sensor; and a microprocessor in the control unit that causes the temperature indicator to provide different visual signals in response to detected ambient temperatures exceeding different threshold temperatures.

17. A personal situation awareness system operable to be coupled to a wearer for identifying, monitoring and evaluating hazardous or potentially hazardous conditions comprising:

a control unit operable to be coupled to the wearer having electronics operable to communicate signals associated with the at least one hazardous or potentially hazardous condition;

a physiological sensor mounted on a mechanical arm configurable to keep the sensor within a filed of view of the wearer, said physiological sensor operable to measure and evaluate at least one physiological condition of the wearer; and a first indicator and second indicator operable to display within the field of vision of the wearer an indication representing the at least one hazardous or potentially hazardous condition.

* * * * *